US005791588A

United States Patent [19]

Lindstrand

[11] Patent Number: 5,791,588

[45] Date of Patent: Aug. 11, 1998

[54] DISPOSABLE DRUM HAVING PARTICULARLY DIMENSIONAL CENTRAL PLUG

[75] Inventor: Ulf Lindstrand, Fengersfors, Sweden

[73] Assignee: Ulvator AB, Stockholm, Sweden

[21] Appl. No.: 714,181

[22] PCT Filed: Mar. 28, 1995

[86] PCT No.: PCT/SE95/00328

§ 371 Date: Sep. 27, 1996

§ 102(e) Date: Sep. 27, 1996

[87] PCT Pub. No.: WO95/26313

PCT Pub. Date: Oct. 5, 1995

[30] Foreign Application Priority Data

Mar. 29, 1994 [SE] Sweden ..... 9401047-7

[51] Int. Cl.[6] ..... B65H 75/14

[52] U.S. Cl. ..... 242/608; 242/609.1; 242/609.4; 242/613.4; 156/91

[58] Field of Search ..... 242/608, 608.2, 242/608.6, 609, 609.1, 609.4, 613.4, 613.5, 578, 578.2; 156/91

[56] References Cited

U.S. PATENT DOCUMENTS

| | | | |
|---|---|---|---|
| 139,326 | 5/1873 | Obrist | 242/609.4 |
| 786,698 | 4/1905 | Wardwell | 242/609 X |
| 1,935,367 | 11/1933 | Lippitt et al. | 242/613.5 |
| 2,704,642 | 3/1955 | Harris et al. . | |
| 2,828,090 | 3/1958 | Steinback . | |
| 2,992,789 | 7/1961 | Sardeson | 242/608 |
| 3,521,833 | 7/1970 | Ridgeway et al. | 242/613.4 X |
| 3,924,743 | 12/1975 | Bittner | 242/613.5 X |
| 4,012,009 | 3/1977 | O'Malley et al. . | |
| 4,484,715 | 11/1984 | DeMarco et al. | 242/613.5 |
| 4,977,930 | 12/1990 | Munk et al. | 242/613.5 X |
| 5,400,567 | 3/1995 | Lindstrand . | |
| 5,417,384 | 5/1995 | Lindstrand . | |
| 5,513,820 | 5/1996 | Meyer | 242/613.5 |
| 5,556,055 | 9/1996 | Lindstrand . | |

FOREIGN PATENT DOCUMENTS

| | | | |
|---|---|---|---|
| 658216 | 1/1965 | Belgium . | |
| 2223994 | 10/1974 | France . | |
| 37 12680 | 10/1988 | Germany . | |
| 9103714 | 6/1993 | Sweden . | |
| 9200478 | 8/1993 | Sweden . | |
| 2160499 | 12/1985 | United Kingdom | 242/608 |

*Primary Examiner*—Donald P. Walsh
*Assistant Examiner*—William A. Rivera
*Attorney, Agent, or Firm*—Nixon & Vanderhye PC

[57] ABSTRACT

A disposable drum of all non-metallic material is used for coiling or uncoiling cables or other flexible objects. The drum includes a stable sleeve, two end elements, and two central plugs, the end elements either integral with the plugs or disposed over the sleeve. The central plugs cooperate with the end elements to clamp the sleeve firmly between them, a frictional engagement being provided between the plugs and sleeve. Each plug has an expansion part and a friction part, the expansion and friction parts typically being conical or curved, and having a wide variety of different specific relationships between them.

24 Claims, 10 Drawing Sheets

DISPOSABLE DRUM HAVING PARTICULARLY DIMENSIONAL CENTRAL PLUG

BACKGROUND AND SUMMARY OF THE INVENTION

The present invention relates to a metal-free disposable drum intended for a continuous flexible object and having a diameter within the interval 200–1200 mm, consisting of a cylindrical, form-stable sleeve with parallel end surfaces and with a predetermined inner diameter Dhi, two circular end elements and two central plugs with a central aperture for a shaft member for winding and unwinding the object, each end element having a central aperture to receive the sleeve, the end element and central plug being arranged to receive between them and firmly clamp the end portion of the sleeve to form a friction joint, the central plug having a leading expansion part arranged to expand the sleeve upon axial insertion of the central plug into the sleeve, and an adjacent friction part arranged to produce friction engagement with the sleeve after full insertion of the central plug into the sleeve, and to cooperate with the end element arranged radially outside it so that the sleeve is firmly clamped by friction engagement between the central plug and the end element, the expansion part and friction part together having an axial dimension that is 50–200% larger than the thickness of one end element. The invention also relates to a method of manufacturing such a metal-free disposable drum.

It is known to use disposable drums with a size of 400 mm, this dimension referring to the diameter of the end pieces. The disposable drums are designed in such a manner that the joint between the end pieces and the sleeve forming the core is not sufficiently strong to be used for sizes larger than 500 mm. Wooden drums of conventional type are therefore still used for these sizes. However, such wooden drums are expensive and must therefore be re-used in order to make the handling of cable and line more economical as a whole. However, the return system functions most unsatisfactorily, thereby making the handling of cable and line less economical. Another drawback is that the end pieces of the wooden drums, made of layers of planks nailed together, are easily damaged. Such damage to the timber constitutes considerable risk to the people, who often have to handle the drums under difficult conditions, as well as the actual cable or line easily becoming damaged as it is being uncoiled from the rotating wooden drum, particularly if the cable or line is running from the coil in a direction not perpendicular to the axis of rotation of the drum. The damage may be so serious that the entire coil of cable or line or parts thereof must be discarded. Interruptions also occur, i.e. the work of lying cables or lines are delayed. Another problem with wooden drums is that the center of rotation does not usually coincide with that of the sleeve and therefore not with the central axis of the coil either. This is extremely unsatisfactory and entirely unacceptable for opto-cable, for instance, which is very sensitive and may easily be damaged as a result of being out-of-line during coiling or uncoiling. Deformation caused by the nature of the timber (not dead material) and faults or difficulties in manufacturing the wooden drums contribute to the effect making the drums out-of-line. One suggestion for reducing this problem has been to replace the wooden drum core formed of planks with a sleeve of iron. However, this suggestion does not solve all the problems and also creates new problems such as increased weight and increased cost.

It is also desirable to be able to burn an inexpensively manufactured drum without any metal waste remaining. It has so far been impossible to satisfy this desire in the case of the sizes under consideration here, viz. up to 1200 mm, since the drums are assembled using various metal parts such as nails and bolts.

Another problem is that a drum supplied is not utilized to its full capacity since customers order smaller quantities of a cable, etc. than the drum can hold and there is usually no other suitably sized drum in the standard range, for the length ordered. It is therefore also desirable to be able to easily adjust the capacity of a disposable drum to the length of cable, etc. ordered, thereby enabling savings in material, as well as storage and transport space.

The object of the invention is to eliminate the problems mentioned above and provide a disposable drum that replace conventional wooden drums of sizes up to 1200 mm (outer diameter of end piece) and that satisfies these desires.

The metal-free disposable drum is characterized in that the peripheral surface of the expansion part is conical or curved outwardly and has a predetermined diameter D1 measured furthest away from the friction part and a predetermined diameter D2 at the transition to the friction part, and the peripheral surface of the friction part is conical, cylindrical or curved outwardly and has a predetermined diameter D3 measured furthest away from the expansion part, where $D1 \leqq Dhi$ $D2 > Dhi$, viz. 2–10 mm $D3 \geqq D2$ or $< D2$, that the expansion part has a conical surface with a conicity of less than 10°, and greater than 3°, preferably greater than 5°, or a curved surface that generates a conical chord surface at the two diameters D1 and D2, with the same conicity, and that the friction part has a cylindrical surface where $D3=D2$, or a positive conical surface where $D3>D2$ with a conicity of less than 6°, preferably less than 3°, that in each case is less than the conicity of the conical expansion part, or a negative conical surface where $D3<D2$, with a conicity of less than 3°, or a curved surface that generates a positive or, alternatively, a negative conical chord surface where $D3>D2$ and $D3<D2$, respectively, at the two diameters D2 and D3 with a conicity of less than 6°, preferably less than 3°, and less than 3°, respectively.

The method according to the invention is characterized in that the two end elements are applied on the sleeve and adjusted to a distance from the end surfaces of the sleeve that is greater than the thickness of a central plug, that the central plugs are placed axially in the end openings of the sleeve and pressed axially in to frictional engagement during the initial expansion of the end parts of the sleeve, that the end elements are thereafter parallel-displaced in a direction away from each other and pressed over the expanded end portions of the sleeve until the end elements are radially aligned with the friction parts of the central plugs.

The expressions "axial insertion", "placed axially" and "pressed in axially" mean that the central plug assumes a position at right angles to the central axis of the sleeve, that the central axes of the central plug and of the sleeve coincide and that the central plug is displaced in parallel into the sleeve.

The invention will be described further in the following with reference to the drawings.

DETAILED DESCRIPTION OF THE DRAWINGS

Figure 3:
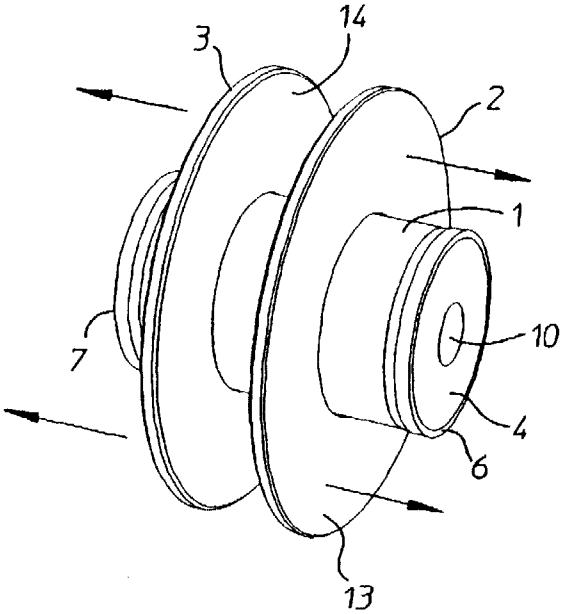
FIGS. 2 and 3 are perspective views of the parts of the disposable drum and show the various steps in the manufacture of the disposable drum according to FIG. 1.
Figure 1:
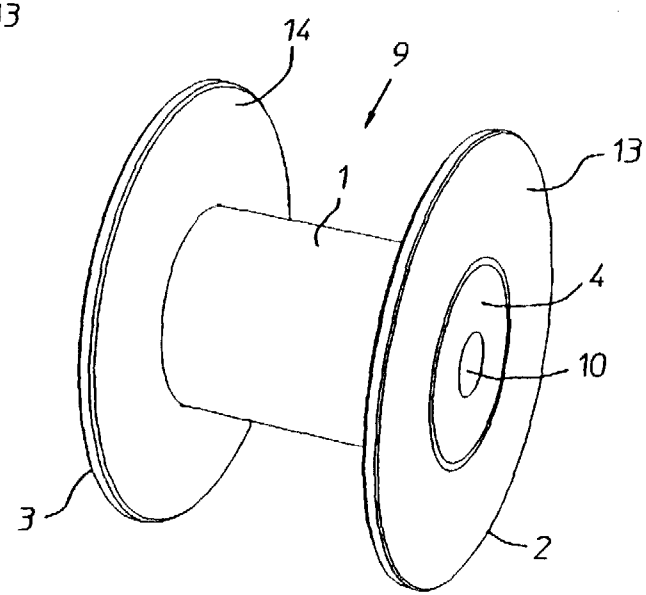
FIG. 1 is a perspective view of a disposable drum in accordance with the present invention.
Figure 2:
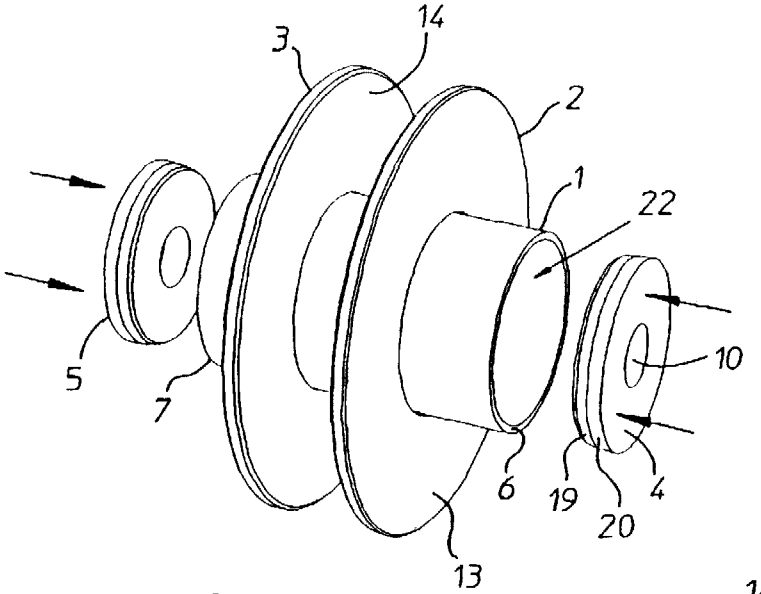
Figure 6:
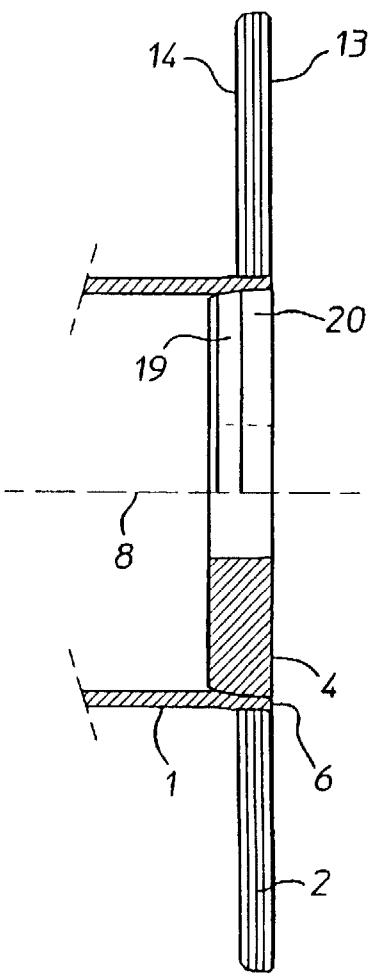
FIGS. 4–6 are longitudinal sectional views through the parts of the disposable drum and show the various steps in the manufacture of the disposable drum according to FIG. 1.
Figure 5:
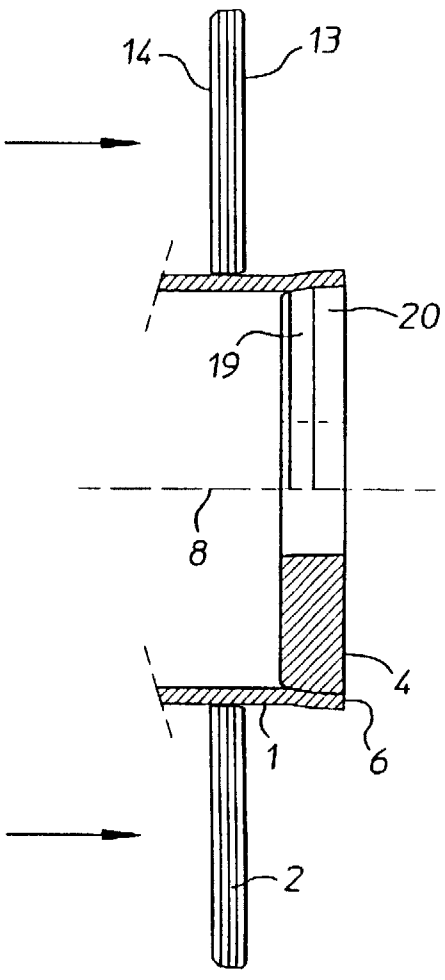
Figure 4:
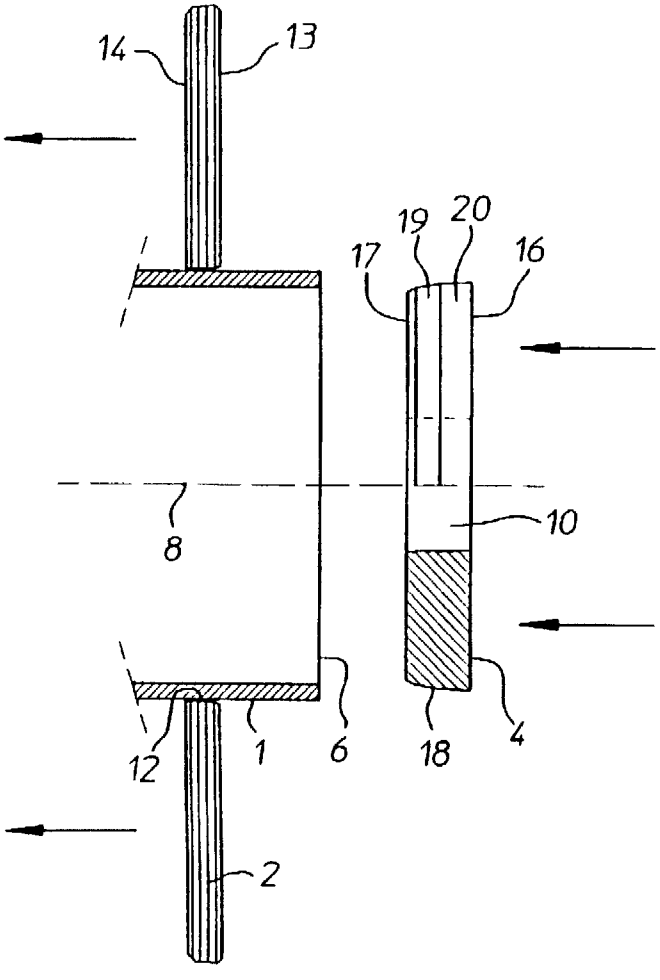
Figure 9:
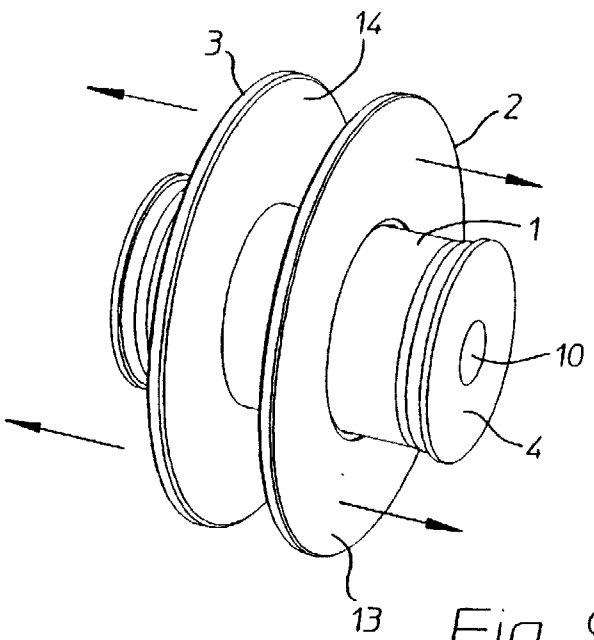
FIGS. 8 and 9 are perspective views of the parts of the disposable drum and show the various steps in the manufacture of the disposable drum according to FIG. 7.
Figure 7:
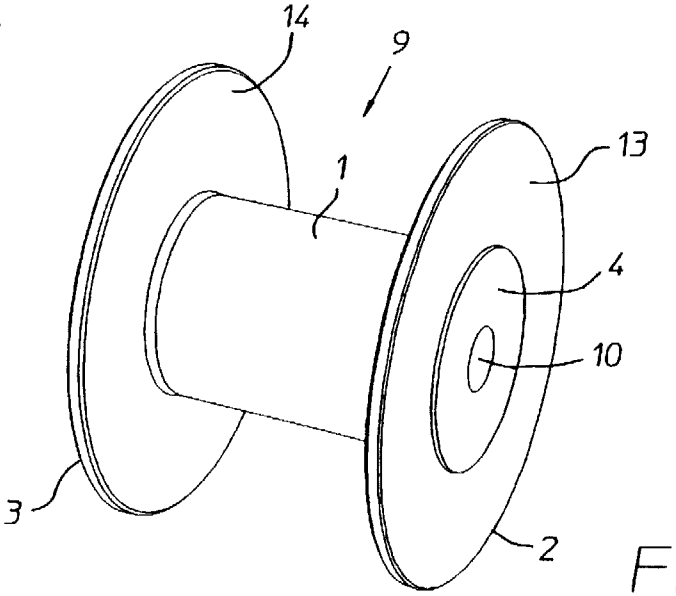
FIG. 7 is a perspective view of a disposable drum according to a second embodiment of the invention.
Figure 8:
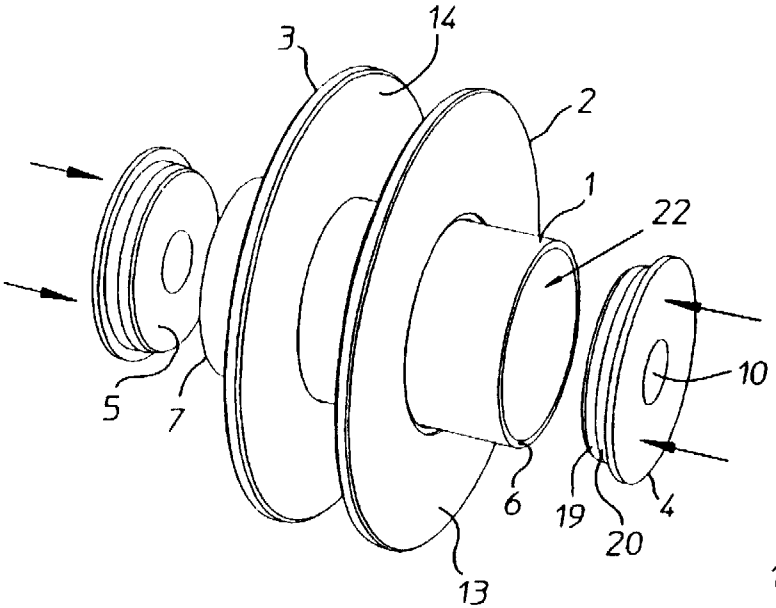
Figures 10, 11, 12:
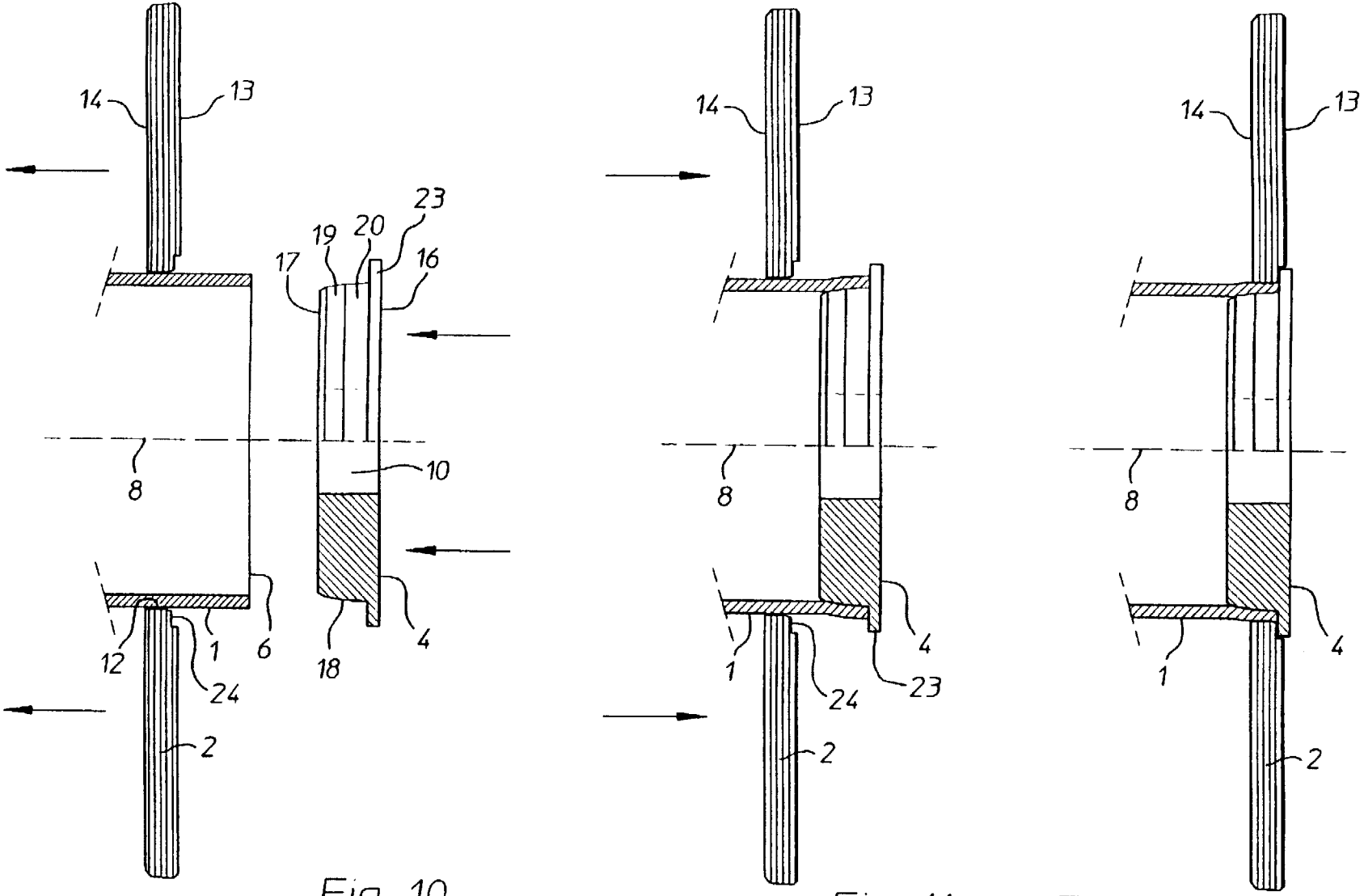
FIGS. 10–12 are longitudinal sectional views through the parts of the disposable drum and show the various steps in the manufacture of the disposable drum according to FIG. 7.

FIG. 1 shows in perspective a disposable drum manufactured in accordance with the method illustrated in FIGS. 2–6 and consisting of a form-stable cylindrical sleeve 1, two circular form-stable end elements 2, 3 and two central plugs 4, 5. The sleeve 1 has flat end surfaces 6, 7, located perpendicular to the central axis 8 of the sleeve. The end elements 2, 3 define between them a space 9 for a coil of a continuous object comprising cable, line, wire, wire cable, rope, cord, narrow ribbon, hosing or other easily coiled, flexible object. Each central plug has a central aperture 10 to receive a shaft or two opposing shaft pivots of equipment for coiling or uncoiling the cable, etc. The sleeve suitably consists of cardboard, manufactured from layers of cardboard glued together with waterproof adhesive, and has a constant predetermined wall thickness to ensure sufficient form rigidity to be able to carry the coil. The end elements suitably consist of a wood chip material or plywood whereas the central plugs suitably consist of a wood chip material.

The size of the disposable drums is within the interval 200–1200 mm, this size referring to the diameter of the end elements.

Thanks to the invention it is easy to adjust the capacity of the drum to the quantity of cable, etc. desired by a customer for a particular purpose, by choosing a sleeve length which will ensure that the space between the end elements will be utilized to the full for each individual order.

The disposable drum is entirely free from metal objects. Each end element 2, 3 has parallel outer and inner sides 13, 14 and a central aperture 12 with a cylindrical engagement surface and a bevelled engagement surface near the inner side 13. The size of the central aperture is such that the end element 2, 3 can be parallel-displaced as desired in order to receive the sleeve 1, without becoming wedged during assembly. The size also has an upper value that must not be exceeded since the desired friction joint cannot otherwise be achieved. To take these factors into consideration the diameter of the central aperture is from 0.1 to 1.0 mm, preferably from 0.2 to 0.5 mm, larger than the outer diameter of the sleeve 1. The thickness of the end element is 10–35 mm depending, amongst other factors, on the size of the disposable drum.

Each central plug 4, 5 has parallel outer and inner sides 16, 17 and a peripheral or circumferential surface 18 which, in the embodiment shown in FIGS. 1–6, extends between the outer and inner sides 16, 17.

The disposable drum shown in FIGS. 7–12 differs from that according to FIGS. 1–6 only in that the central plugs 4, 5 are provided with a radial support flange 23 with sufficient axial dimension to be able to withstand forces exerted on it by the end elements 2, 3, without collapsing. The radial dimension is larger than the thickness of the sleeve 1 so that the support flange 23 protrudes outside the sleeve 1 to form a counter support for the end element 4, 5. The outer diameter of the support flange 23 is suitably 6–45 mm larger than the outer diameter of the sleeve 1. The support flange 23 is preferably fully or partially recessed into a groove 24 in the end element. The diameter of the groove 24 is slightly greater, e.g. 1–3 mm, than the diameter of the support flange 23, thereby forming a gap between them. Such a gap permits axially outwardly directed point loading on the end element, without the central plug being affected. The support flange 23 prevents shearing in the sleeve and provides a beneficial end stop for the end element.

Figure 13:
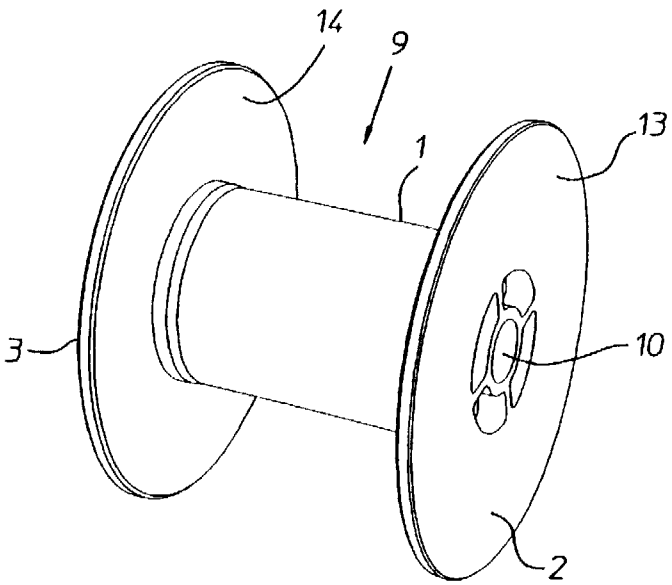
FIG. 13 is a perspective view of a modified form of a disposable drum according to the present invention.
Figure 14:
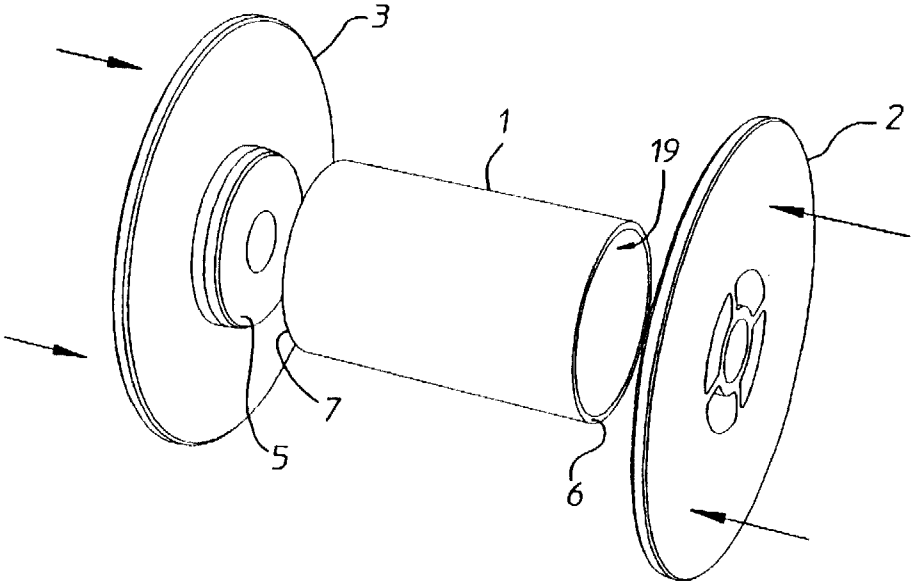
FIG. 14 through 16 schematically illustrate a method of assembly of the drum of FIG. 13.
Figure 16:
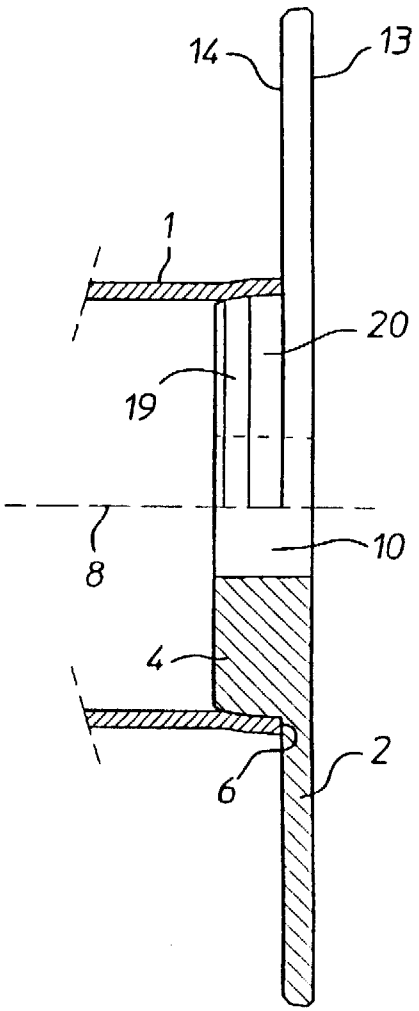
Figure 15:
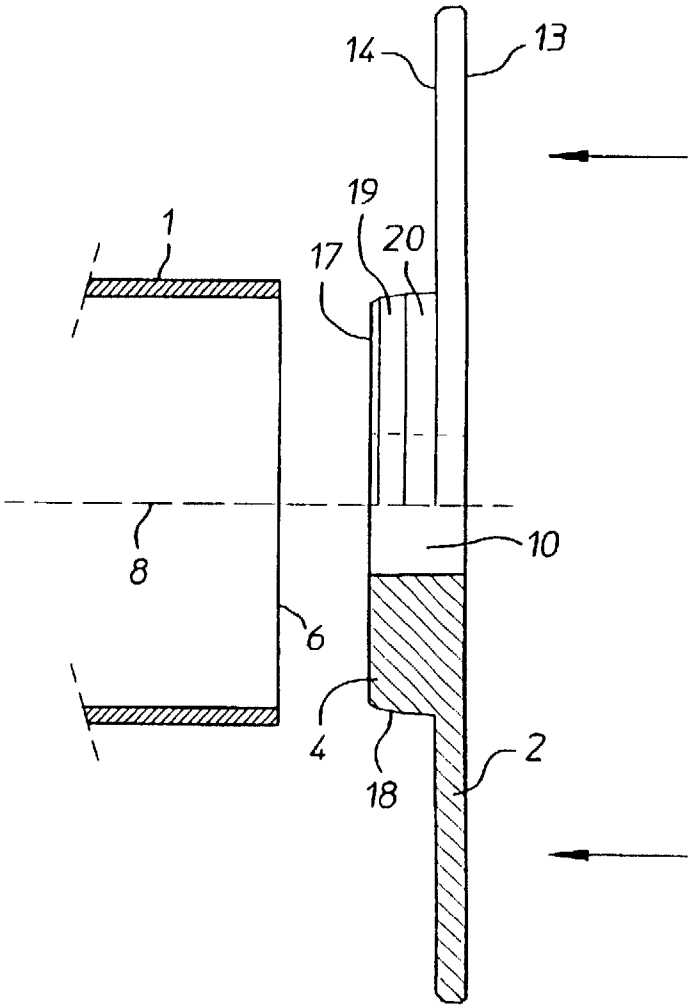

FIG. 13 shows a modified embodiment of a disposable drum, manufactured in the manner illustrated in FIGS. 14–16. In this case the end element 2, 3 and central plug 4, 5 are manufactured in one piece and the friction joint is achieved by pressing in the central plug 4, 5 by applying an outer pressure on the end element 2, 3 so that the end portion of the sleeve is first expanded by the expansion part 19 and then brought into frictional cooperation with the friction part 20, when the sleeve abuts the inner side 14 of the end element 2, 3. The controlled expansion of the end portion of the sleeve creates radial forces acting against the friction part 20, thereby increasing the strength of the friction joint. Such a disposable drum is primarily intended for smaller dimensions of end elements, viz. 200–600 mm.

Figure 17:
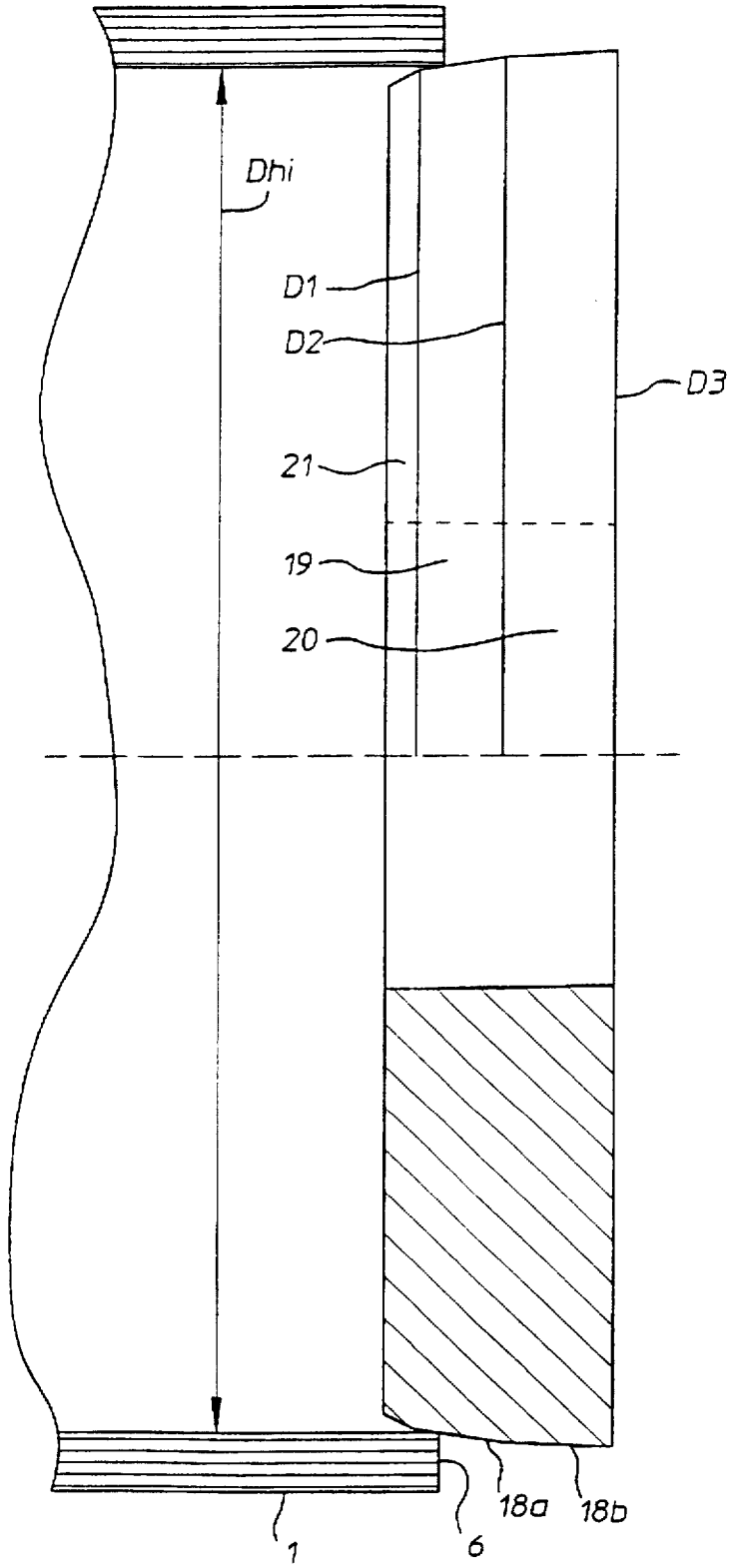
FIG. 17 through 20 are side detail views, partly in cross-section and partly in elevation, of four different detailed embodiments of the central plug, showing different configurations of the peripheral surfaces of the expansion and friction parts thereof.
Figure 18:
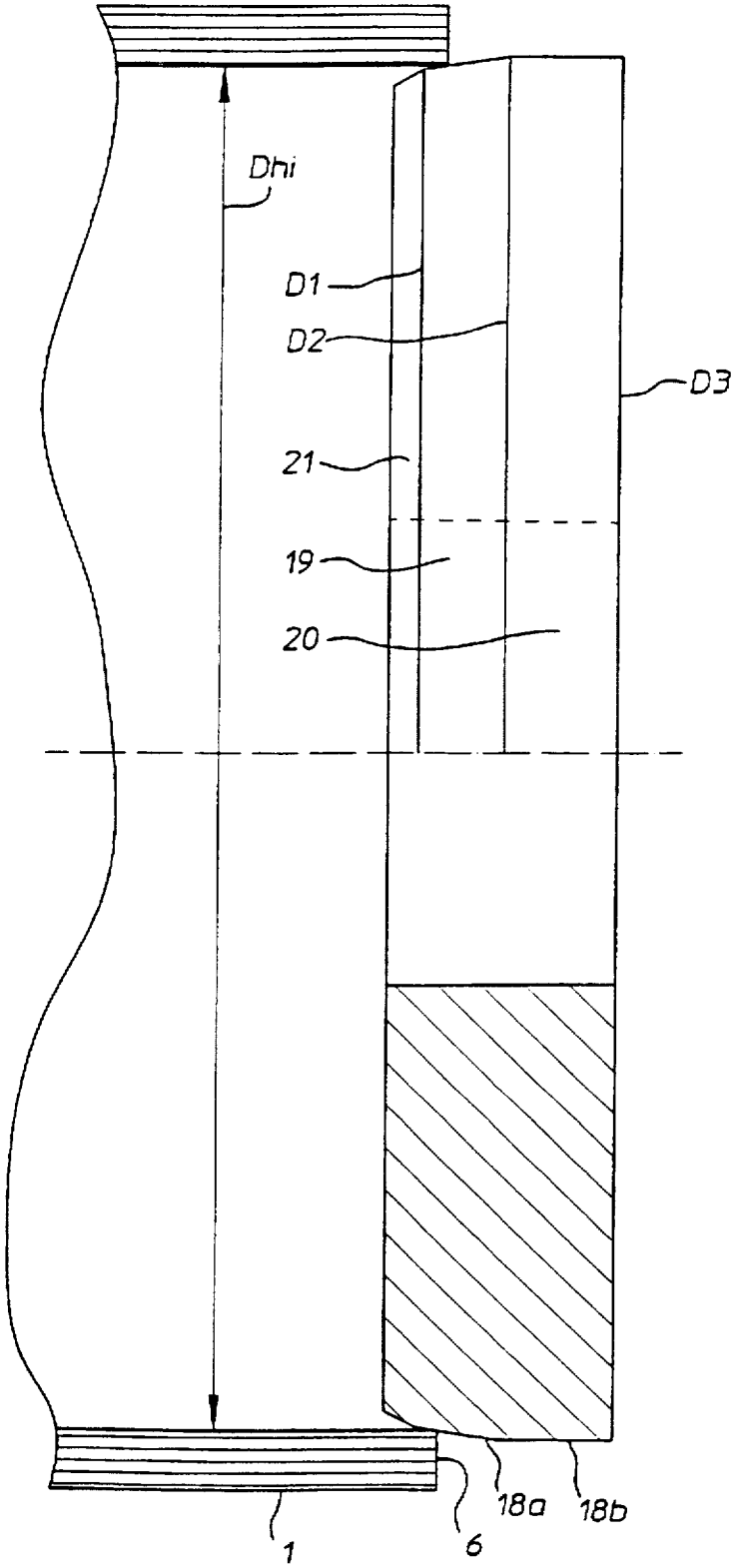
Figure 19:
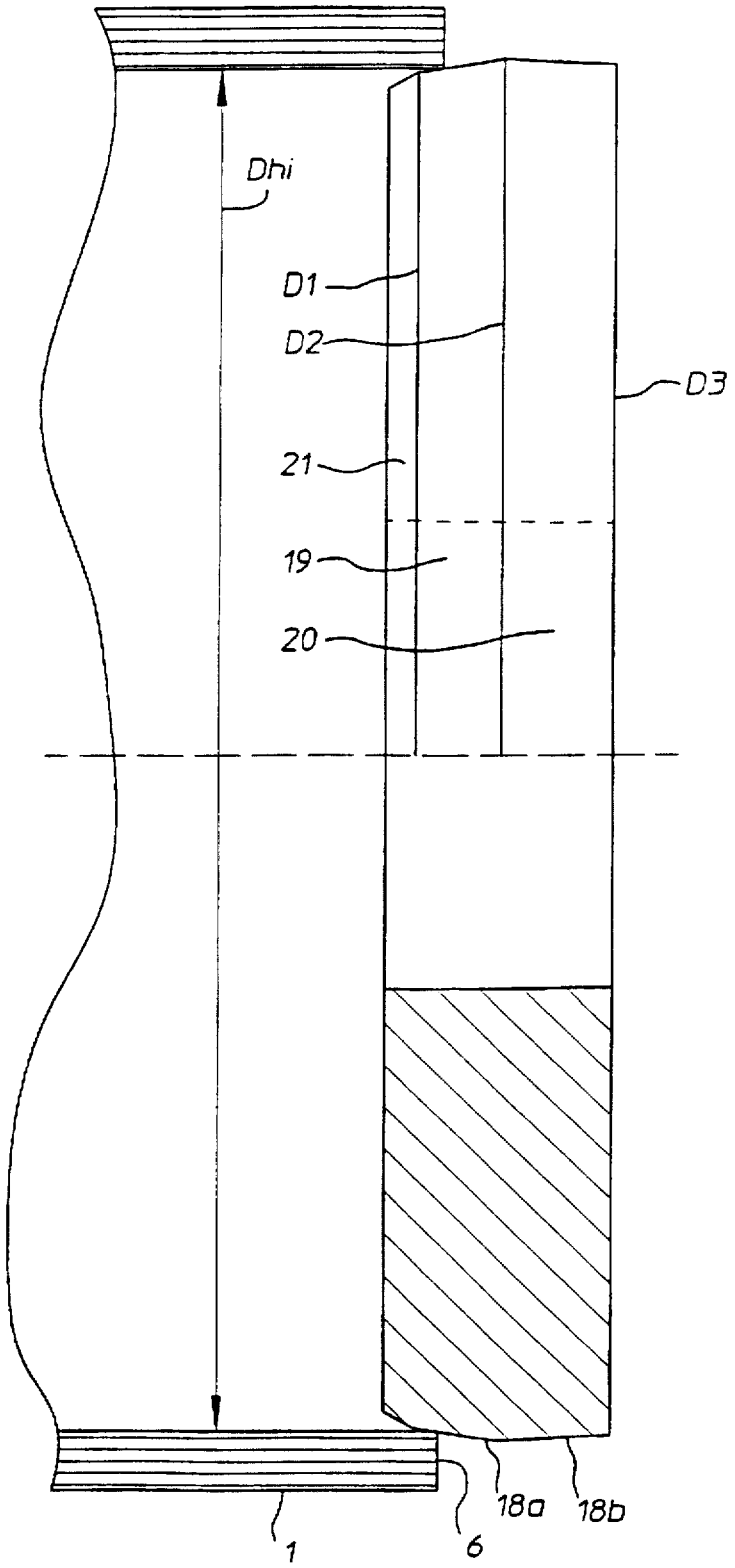
Figure 20:
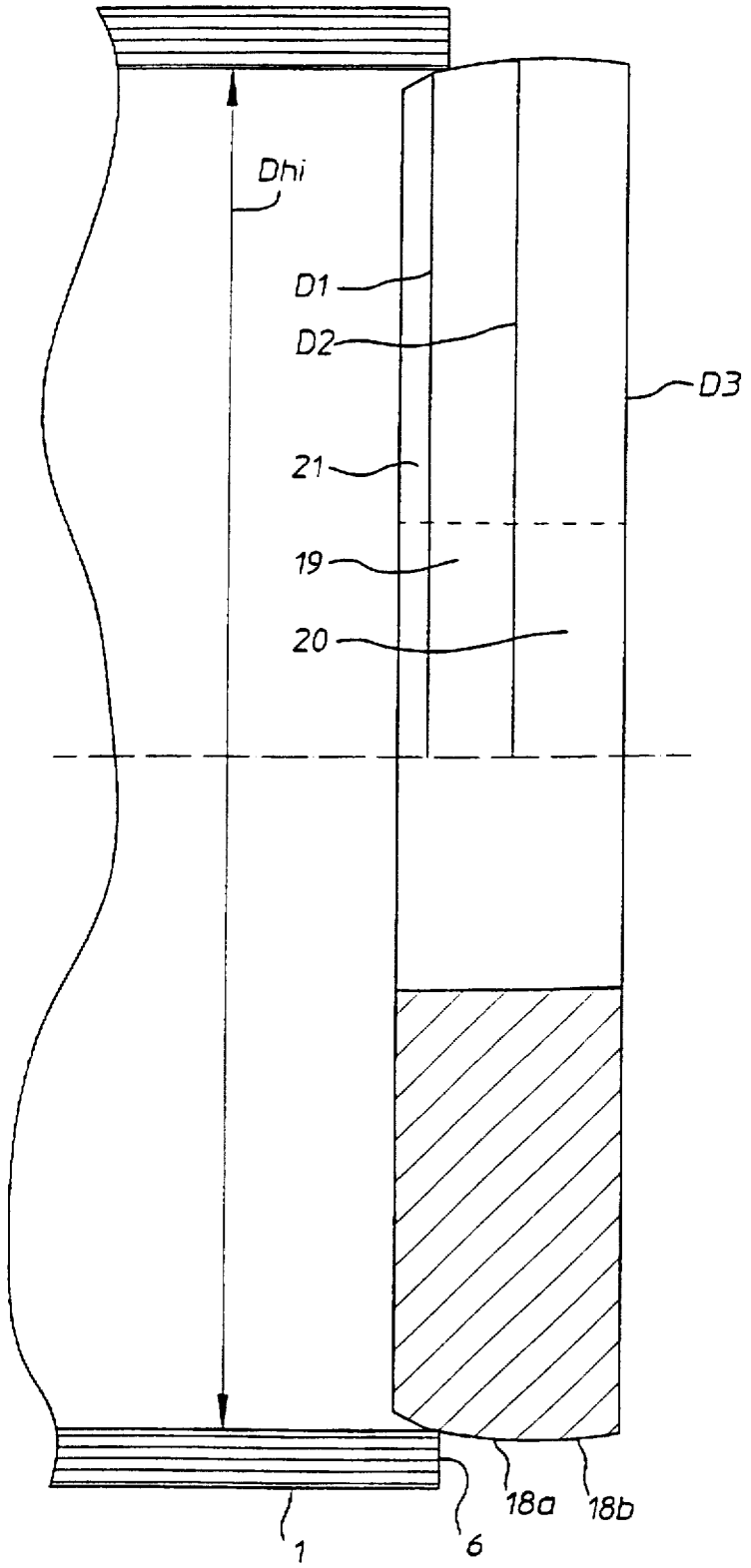

The central plug 4, 5 has a thickness 50–200% larger than the thickness of the end element 2, 3. It has a leading expansion part 19, seen in direction of insertion, and a friction part 20 immediately adjacent thereto, located nearest the outer side 16 of the two parts. In the embodiment shown in FIGS. 1–6 these two parts 19, 20 have conical surfaces 18*a*, 18*b* (see FIG. 17), but with different conicity. The central plug 4, 5 suitably also has a short leading bevel 21 with large conicity, e.g. 40°–45°, to facilitate initial guided insertion of the central plug 4, 5 into the through-running hollow 22 of the sleeve. The friction part 20 has a thickness that is 40–60% of the thickness of the central plug, minus the bevel.

As can be seen in FIGS. 17–20 the central plug 4, 5 may be shaped in many different ways as regards the expansion part 19 and friction part 20. The peripheral surface 18*a* of the expansion part 19 is conical according to FIGS. 17, 18 and 19 or curved outwardly according to FIG. 20, and has a predetermined diameter D1 measured furthest away from the friction part 20 and a predetermined diameter D2 at the transition to the friction part 20. The peripheral surface (18*b*) of the friction part 20 is conical according to FIGS. 17 and 19, cylindrical according to FIG. 18 or curved outwardly according to FIG. 20, and has a predetermined diameter D3 measured furthest away from the expansion part 19. Since the two parts 19 and 20 continue into each other, the diameter D2 is the same for both. For the purpose of the invention the following ratio applies D1≦Dhi D2>Dhi D3≧D2 or<D2.

D1 is generally from 0 mm up to 2 mm less than Dhi, whereas D2 is generally from 2 up to 6 mm larger than Dhi.

The expansion part 19 may have a conical surface (FIGS. 17, 18 and 19) with a conicity greater than 3°, preferably greater than 5°, and less than 10° or a curved surface (FIG. 20) that generates a conical chord surface at diameters D1 and D2 with a conicity greater than 3°, preferably greater than 5°, and less than 10°.

The friction part 20 may have a cylindrical surface 18*b*, in which case D3=D2 (FIG. 18), or a positive conical surface 18*b*, in which case D3>D2 (FIG. 17), with a conicity of less than 6°, preferably less than 3°, that in each case is less than the conicity of the conical expansion part 19. Alternatively the friction part has a negative conical surface 18*b*, in which case D3<D2 (FIG. 19), with a conicity of less than 3°. According to another alternative the friction part has a curved surface 18*b* that generates a positive or, alternatively, a negative conical chord surface where D3>D2 (not shown) and D3<D2 (FIG. 20), respectively, at the two diameters D2 and D3 with a conicity of less than 6°, preferably less than 3°, and less than 3°, respectively. A friction part with a negative conical surface, or a curved surface generating a negative conical chord surface, is particularly advantageous in the case of a central plug manufactured in one piece with the end element, i.e. a combination of FIG. 19 or FIG. 20 and FIGS. 15 and 16 since the object, particularly a thin wire or line, forming the coil, will press the end parts of the sleeve in towards the negative conical surface of the friction part, thereby producing a wedge lock in situ which further reinforces the joint.

The disposable drum is assembled in a completely new manner, in that the end elements 2, 3 are first applied on the sleeve before at least one of the central plugs 4, 5 is brought into position in the end opening 22 of the sleeve, and the end elements are parallel-displaced to starting positions at a distance from the end surfaces 6, 7 of the sleeve that is greater than the thickness of the central plug. The central plugs—or the second central plug if the first one has already been brought into position before the end elements—are then inserted into the end openings 22 of the sleeve 1 and pressed into permanent positions with their outer sides 16 coinciding with the end surfaces 6, 7 of the sleeve. The end elements are thereafter parallel-displaced in the direction from each other and pressed out against the end portions of the sleeve 1, now conical in shape, until the outer sides 13 of the end elements are aligned in plane with the outer sides 16 of the central plugs and the end surfaces 6, 7 of the sleeve 1. An extremely strong friction joint is thus achieved and the forces acting axially outwardly on the central plugs are so much smaller than the radially directed forces that they are unable to budge the central plug from its supporting initial position when the central plugs have been positioned before the friction joint was formed by the surrounding end elements. The load then exerted by the coil of cable, etc. on the inner sides 14 of the end elements will result in axially outwardly directed forces that beneficially reinforce the wedge joint.

If desired a waterproof adhesive may be applied on the engagement surfaces in order to strengthen the friction joint and further improve the resistance of the disposable drum to damp and wet. For the latter purpose it is suitable to apply adhesive on the end surfaces 6, 7 as well since these are usually sawn surfaces. The adhesive also has a lubricating effect so that the surfaces slide along each other more easily during assembly.

No bolts or steel parts are therefore required to assemble the drum, which in turn means that all material can be discarded or burned on site once the line or cable has been uncoiled, since all material is environmentally friendly.

It has surprisingly been found that friction joints produced in accordance with the invention have a strength that is considerably greater, i.e. more than 50% greater, than a friction joint produced in conventional manner.

Extensive tests have shown that the stated ratios and specific shape of the central plug are extremely important in the production of disposable drums having sleeve-end element joints that fulfil the strength requirements. According to the invention D1 shall≦Dhi. If D1>Dhi the sleeve will be damaged and deformed by the central plug when it is pressed into the sleeve. According to the invention D2=Dhi+2 to 10 mm. If this dimension is smaller the central plug will not be sufficiently secured to the sleeve and if the dimension is larger the sleeve will crack when the central plug is pressed in. According to the invention the friction part 20 shall have less conicity than the expansion part 19. If the friction part 20 is given larger conicity than the expansion part 19 the sleeve will crack. According to the invention the expansion part 19 shall have a conicity of between 3° and 10°. If the conicity is less than 3°, the inner side of the sleeve will be damaged when the central plug is pressed in and if the conicity is more than 10°, too sharp a transition (egg-like) will be formed between the expansion part 19 and the friction part 20. According to the invention the friction part 20 shall be cylindrical or have a positive conicity of <6°, or a negative conicity of <3°. If the positive conicity is >6° the sleeve will crack. The same thing occurs when the negative conicity >3°, when a line or wire is wound around the sleeve and pressed into the end parts of the sleeve, radially to the conical surface which is then too deep.

I claim:

1. A disposable drum, comprising:

a cylindrical form-stable sleeve of cardboard having an exterior continuous surface for coiling a continuous flexible object thereon, said sleeve having a central axis concentric with said exterior continuous surface, an exterior diameter of between 200–1200 mm, an inner diameter Dhi, and first and second end surfaces that are parallel to each other and substantially perpendicular to said central axis;

first and second wood chip material or plywood end elements each having a circular configuration in plan, a central opening parallel to said central axis and having a diameter larger than said exterior diameter of said sleeve, and a thickness dimension parallel to said central axis; and first and second wood chip material central plugs, each plug having a central aperture for receiving a shaft member for rotating said plugs, sleeve and end elements to coil or uncoil a continuous flexible object thereon or therefrom;

said first and second end elements cooperating with said first and second central plugs, respectively, to firmly clamp said sleeve, end elements, and central plugs together, with said sleeve adjacent said first and second end surfaces, respectively, being clamped between said first and second end elements and said first and second central plugs, respectively; and each said central plug having an expansion part and a friction part, said parts extending parallel to said central axis and having a collective axial dimension that is between 50–200% greater than said thickness of one of said end elements;

said expansion part having an exterior peripheral surface with a diameter D1 measured at a portion thereof furthest from said friction part and a diameter D2 at a transition between said expansion and friction parts;

said friction part having an exterior peripheral surface with a diameter D3 at a portion thereof furthest from said expansion part; and wherein D1≧Dhi, and D2 is greater than Dhi by between 2–10 mm, and D3 may be equal to, greater than, or less than D2.

2. A disposable drum as recited in claim 1 wherein said expansion part exterior peripheral surface is conical and has conicity of less than 10° and greater than 3°.

3. A disposable drum as recited in claim 2 wherein said friction part exterior peripheral surface is cylindrical, and D3=D2.

4. A disposable drum as recited in claim 3 wherein each said end element central opening has a diameter that is 0.1–1.0 mm greater than said sleeve exterior diameter, wherein D1 is between an amount greater than zero to 2 mm less than Dhi, and wherein each central plug friction part has an axial dimension which is 40–60% of said collective axial dimension.

5. A disposable drum as recited in claim 2 wherein said friction part exterior peripheral surface is conical and has a conicity of less than 6° and said conicity less than the conicity of said expansion part exterior peripheral surface, and D3>D2.

6. A disposable drum as recited in claim 5 wherein each central plug friction part has an axial dimension which is 40–60% of said collective axial dimension.

7. A disposable drum as recited in claim 5 wherein D1 is between an amount greater than zero to 2 mm less than Dhi.

8. A disposable drum as recited in claim 5 wherein each said central plug has a support flange adjacent said friction part most remote from said expansion part, said support flange having an exterior diameter that is 6–45 mm greater than said sleeve exterior diameter, and abuts one of said end elements.

9. A disposable drum as recited in claim 5 wherein each said end element central opening has a diameter that is 0.1–1.0 mm greater than said sleeve exterior diameter.

10. A disposable drum as recited in claim 2 wherein said friction part exterior peripheral surface is conical and has a conicity of less than 3°, and said conicity less than the conicity of said expansion part exterior peripheral surface, and D3<D2.

11. A disposable drum as recited in claim 10 wherein each said end element central opening has a diameter that is 0.1–1.0 mm greater than said sleeve exterior diameter, wherein D1 is between an amount greater than zero to 2 mm less than Dhi, and wherein each central plug friction part has an axial dimension which is 40–60% of said collective axial dimension.

12. A disposable drum as recited in claim 1 wherein each said end element central opening has a diameter that is 0.1–1.0 mm greater than said sleeve exterior diameter.

13. A disposable drum as recited in claim 1 wherein each said central plug has a support flange adjacent said friction part most remote from said expansion part, said support flange having an exterior diameter that is 6–45 mm greater than said sleeve exterior diameter, and abuts one of said end elements.

14. A disposable drum as recited in claim 13 wherein each end element has formed in a surface thereof most remote from said other end element a recessed annular groove having a diameter slightly greater than said exterior diameter of said support flange, and which receives said support flange therein.

15. A disposable drum as recited in claim 1 wherein D1 is between an amount greater than zero to 2 mm less than Dhi.

16. A disposable drum as recited in claim 1 wherein each central plug friction part has an axial dimension which is 40–60% of said collective axial dimension.

17. A disposable drum as recited in claim 1, wherein said expansion part exterior peripheral surface is curved and generates a chord surface at said diameters D1 and D2 that has a conicity of less than 10° and greater than 30°.

18. A disposable drum as recited in claim 17, wherein said friction part exterior peripheral surface is curved and generates a chord surface at said diameters D2 and D3 that has a conicity of less than 6°, and said conicity less than the conicity of said expansion part chord surface, and D3>D2.

19. A disposable drum as recited in claim 17, wherein said friction part exterior peripheral surface is curved and generates a chord surface at said diameters D2 and D3 that has a conicity of less than 3°, and said conicity less than the conicity of said expansion part chord surface, and D3>D2.

20. A disposable drum, comprising:

a cylindrical form-stable sleeve of cardboard having an exterior continuous surface for coiling a continuous flexible object thereon, said sleeve having a central axis concentric with said exterior continuous surface, an exterior diameter of between 200–1200 mm, an inner diameter Dhi, and first and second end surfaces that are parallel to each other and substantially perpendicular to said central axis;

first and second wood chip material or plywood end elements each having a circular configuration in plan, and a thickness dimension parallel to said central axis; and first and second wood chip material central plugs, each plug having a central aperture for receiving a shaft member for rotating said plugs, sleeve and end elements to coil or uncoil a continuous flexible object thereon or therefrom;

said first and second end elements integral with said first and second central plugs, respectively;

said first and second central plugs firmly clamped in said sleeve, with said sleeve adjacent said first and second end surfaces, respectively; and each said central plug having an expansion part and a friction part, said parts extending parallel to said central axis and having a collective axial dimension that is between 50–200% greater than said thickness of one of said end elements;

said expansion part having an exterior peripheral surface with a diameter D1 measured at a portion thereof furthest from said friction part and a diameter D2 at a transition between said expansion and friction parts;

said friction part having an exterior peripheral surface with a diameter D3 at a portion thereof furthest from said expansion part; and wherein D1>Dhi, and D2 is greater than Dhi by between 2–10 mm, and D3 may be equal to, greater than, or less than D2.

21. A disposable drum as recited in claim 20 wherein said expansion part exterior peripheral surface is conical and has a conicity of less than 10° and greater than 3°.

22. A disposable drum as recited in claim 20, wherein said expansion part exterior peripheral surface is curved and generates a chord surface at said diameters D1 and D2 that has a conicity of less than 10° and greater than 3°.

23. A method of manufacturing a disposable drum using: a cylindrical form-stable sleeve of cardboard having an exterior continuous surface for coiling a continuous flexible object thereon, the sleeve having a central axis concentric with the exterior continuous surface, and first and second end surfaces that are parallel to each other and substantially perpendicular to the central axis, the end surfaces defining end openings of the sleeve; first and second wood chip material or plywood end elements each having a circular configuration in plan, a central opening parallel to the central axis and having a diameter larger than the exterior diameter of the sleeve, and a thickness dimension parallel to the central axis; and first and second wood chip material central plugs, each plug having a central aperture for receiving a shaft member for rotating the plugs, sleeve and end elements to coil or uncoil a continuous flexible object thereon or therefrom; each the central plug having an expansion part and a friction part, the parts extending parallel to the central axis, said method comprising the steps of sequentially:

(a) providing the sleeve with an exterior diameter of between 200–1200 and an inner diameter Dhi;

(b) applying the two end elements over the sleeve exterior surface of the sleeve and moving the end elements to a position in which they are each spaced from the end surfaces of the sleeve greater than the axial dimension of each of the central plugs;

(c) providing the central plugs with a collective axial dimension that is between 50–200% greater than the thickness of one of the end elements;

(d) providing the expansion part with in exterior peripheral surface with a diameter D1 measured at a portion thereof furthest from the friction part and a diameter D2 at a transition between the expansion and friction parts such that D1≧Dhi and D2 is greater than Dhi by between 2–10 mm.

(e) providing the friction part with an external peripheral surface with a diameter D3 at a portion thereof furthest from the expansion part such that D3 may be equal to, greater than, or less than D2;

(f) inserting the central plugs into the sleeve end openings and pressing the plugs axially through the end openings so that the expansion parts expand the sleeve adjacent the end openings and the friction parts then frictionally engage the sleeve adjacent the end openings; and (g) moving the end elements away from each other over the sleeve until the end elements are radially aligned with the friction parts of the central plugs, and the sleeve is clamped between the end elements and central plugs.

24. A method as recited in claim 23 comprising the further step of, prior to step (b), applying a water-resistant adhesive on cooperating surfaces of at least one of the central plugs and the sleeve so that the adhesive assists in holding the end elements, plugs, and sleeve together in the relative positions thereof achieved after the practice of step (c).

* * * * *

UNITED STATES PATENT AND TRADEMARK OFFICE

CERTIFICATE OF CORRECTION

PATENT NO. : 5,791,588
DATED : August 11, 1998
INVENTOR(S) : LINDSTRAND, Ulf

It is certified that error appears in the above-identified patent and that said letters patent is hereby corrected as shown below:

Title page, item [54] and col. 1. line 2,
replace "DIMENSIONAL" with -- DIMENSIONED --.

Column 9, line 28, insert -- mm -- after "1200".

Column 10, line 10, replace the ". [period]" with a -- ; [semicolon] --.

Signed and Sealed this

Seventeenth Day of November, 1998

Bruce Lehman

*Attest:*

BRUCE LEHMAN

*Attesting Officer*

*Commissioner of Patents and Trademarks*